US007251597B2

(12) United States Patent
Chazan

(10) Patent No.: US 7,251,597 B2
(45) Date of Patent: Jul. 31, 2007

(54) METHOD FOR TRACKING A PITCH SIGNAL

(75) Inventor: Dan Chazan, Haifa (IL)

(73) Assignee: International Business Machines Corporation, Armonk, NY (US)

( * ) Notice: Subject to any disclaimer, the term of this patent is extended or adjusted under 35 U.S.C. 154(b) by 951 days.

(21) Appl. No.: 10/331,451

(22) Filed: Dec. 27, 2002

(65) Prior Publication Data

US 2004/0128124 A1 Jul. 1, 2004

(51) Int. Cl.
*G10L 11/04* (2006.01)

(52) U.S. Cl. ..... 704/207; 704/216

(58) Field of Classification Search ..... None
See application file for complete search history.

(56) References Cited

U.S. PATENT DOCUMENTS 3,978,287 A * 8/1976 Fletcher et al. ..... 704/231
4,076,958 A * 2/1978 Fulghum ..... 704/268
4,696,038 A * 9/1987 Doddington et al. ..... 704/219
4,969,193 A * 11/1990 Scott et al. ..... 704/216
5,774,837 A * 6/1998 Yeldener et al. ..... 704/208
6,330,533 B2 * 12/2001 Su et al. ..... 704/220
6,917,912 B2 * 7/2005 Chang et al. ..... 704/207

* cited by examiner

*Primary Examiner*—David D. Knepper
(74) *Attorney, Agent, or Firm*—Suzanne Erez

(57) ABSTRACT

A method for tracking pitch signal, including receiving a detected pitch signal that consists of a succession of pitch values, and for each current pitch value in the detected signal perform the following steps: constructing sub-sequences of consistent pitch values from neighboring pitch values. Next, calculating significance of the sub-sequences, and selecting a sub-sequence or a collection of consistent subsequences with highest significance. If the current pitch value is not consistent with the sub-sequence with highest significance, smoothing the current pitch value by diving it or multiplying it by an integer value>1, so as to render it consistent with the sub-sequence with highest significance.

26 Claims, 5 Drawing Sheets

METHOD FOR TRACKING A PITCH SIGNAL

FIELD OF THE INVENTION

This invention relates to pitch tracking for Smoothing pitch signals.

BACKGROUND OF THE INVENTION

Pitch detectors are used for a wide range of applications including, for instance, Speech compression (coding), Speech Synthesis, such as speech reconstruction from speech recognition features, and others.

There are known in the art various techniques of pitch detectors, e.g.,

Y. Medan, E. Yair, D. Chazan, Super Resolution Pitch Determination for Speech Signals, IEEE ASSP vol 39 pp 40-48, 1991.

Pitch detectors tend to find in certain occasions integer multiples or integer fractions of the pitch. Most often the reason for this is due to a rapid change of pitch or a transition between two sounds as well as the existence of a raspy or hoarse sound all of which mar the regular structure of the spectrum. The result of this marring is the creation of additional spectral lines which are often at multiples of half the pitch frequency, but one third and one quarter frequencies can occur too. When such additional lines are missed, a multiple of the pitch frequency is found. When they are incorrectly counted a fraction of the pitch frequency is detected.

Applications, such as Speech compression, which use the specified marred pitch signal will manifest degraded performance.

There is accordingly a need in the art to provide for a technique for smoothing marred pitch values in a detected pitch signal.

Related art include:

Robust pitch estimation using an event based adaptive Gaussian derivative filter Shah, A.; Ramachandran, R. P.; Lewis, M. A. Circuits and Systems, 2002. ISCAS 2002. IEEE International Symposium on, 2002. Page(s):II-843-II-846 vol. 2. which aims at finding pitch in noisy speech.

SUMMARY OF THE INVENTION

The invention provides for a method for tracking pitch signal, comprising:

(i) receiving a detected pitch signal that consists of succession of pitch values, and for each current pitch value in the detected signal perform at least the following (ii) to (iv):

(ii) constructing at least one sub-sequence of consistent pitch values from neighboring pitch values;

(iii) calculating significance of said at least one sub-sequences, and selecting a sub-sequence or a collection of consistent subsequences with highest significance;

(iv) if the current pitch value is not consistent with said sub-sequence with highest significance, smoothening the current pitch value by diving it or multiplying it by an integer value>1, so as to render it consistent with said sub-sequence with highest significance.

The invention further provides for a method for tracking pitch signal, comprising:

(i) receiving a detected pitch signal that consists of succession of pitch values, and for each current pitch value in the detected signal as well as any integer multiple and inverse integer multiple thereof, where said integer<predetermined value, perform at least the following (ii) to (iii):

(ii) constructing at least one sub-sequence of consistent pitch values from neighboring pitch values; if a detected pitch value is not consistent with said sub-sequence diving it or multiplying it by an integer value>1, so as to render it consistent with said sub-sequence;

(iii) calculating significance of said at least one sub-sequences, and selecting a sub-sequence with highest significance, thereby rendering the current pitch value smoothened.

Still further, the invention provides for a system for tracking pitch signal, comprising: receiver for receiving a detected pitch signal that consists of succession of pitch values, and for each current pitch value in the detected signal perform at least the following (ii) to (iv), by a processor:

(ii) constructing at least one sub-sequence of consistent pitch values from neighboring pitch values;

(iii) calculating significance of said at least one sub-sequences, and selecting a sub-sequence or a collection of consistent subsequences with highest significance;

(iv) if the current pitch value is not consistent with said sub-sequence with highest significance, smoothening the current pitch value by diving it or multiplying it by an integer value>1, so as to render it consistent with said sub-sequence with highest significance.

Yet further, the invention provides for a system for tracking pitch signal, comprising:

receiver for receiving a detected pitch signal that consists of succession of pitch values, and for each current pitch value in the detected signal as well as any integer multiple and inverse integer multiple thereof, where said integer<predetermined value, perform at least the following (ii) to (iii) by a processor:

(ii) constructing at least one sub-sequence of consistent pitch values from neighboring pitch values; if a detected pitch value is not consistent with said sub-sequence diving it or multiplying it by an integer value>1, so as to render it consistent with said sub-sequence;

(iii) calculating significance of said at least one sub-sequences, and selecting a sub-sequence with highest significance, thereby rendering the current pitch value smoothened.

The invention provides for a computer product containing a computer code for performing tracking pitch signal, including: receiver for receiving a detected pitch signal that consists of succession of pitch values, and for each current pitch value in the detected signal perform at least the following (i) to (iii):

(i) constructing at least one sub-sequence of consistent pitch values from neighboring pitch values;

(ii) calculating significance of said at least one sub-sequences, and selecting a sub-sequence or a collection of consistent subsequences with highest significance;

(iii) if the current pitch value is not consistent with said sub-sequence with highest significance, smoothening the current pitch value by diving it or multiplying it by an integer value>1, so as to render it consistent with said sub-sequence with highest significance.

The invention further provides for a computer product containing a computer code for performing tracking pitch signal, including:

(i) receiving a detected pitch signal that consists of succession of pitch values, and for each current pitch value in the detected signal as well as any integer multiple and inverse integer multiple thereof, where said integer<predetermined value, perform at least the following (ii) to (iii):

(ii) constructing at least one sub-sequence of consistent pitch values from neighboring pitch values; if a detected pitch value is not consistent with said sub-sequence diving it or multiplying it by an integer value>1, so as to render it consistent with said sub-sequence;

(iii) calculating significance of said at least one sub-sequences, and selecting a sub-sequence with highest significance, thereby rendering the current pitch value smoothed.

BRIEF DESCRIPTION OF THE DRAWINGS

In order to understand the invention and to see how it may be carried out in practice, a preferred embodiment will now be described, by way of non-limiting example only, with reference to the accompanying drawings, in which.

DETAILED DESCRIPTION OF THE INVENTION

Figure 1:
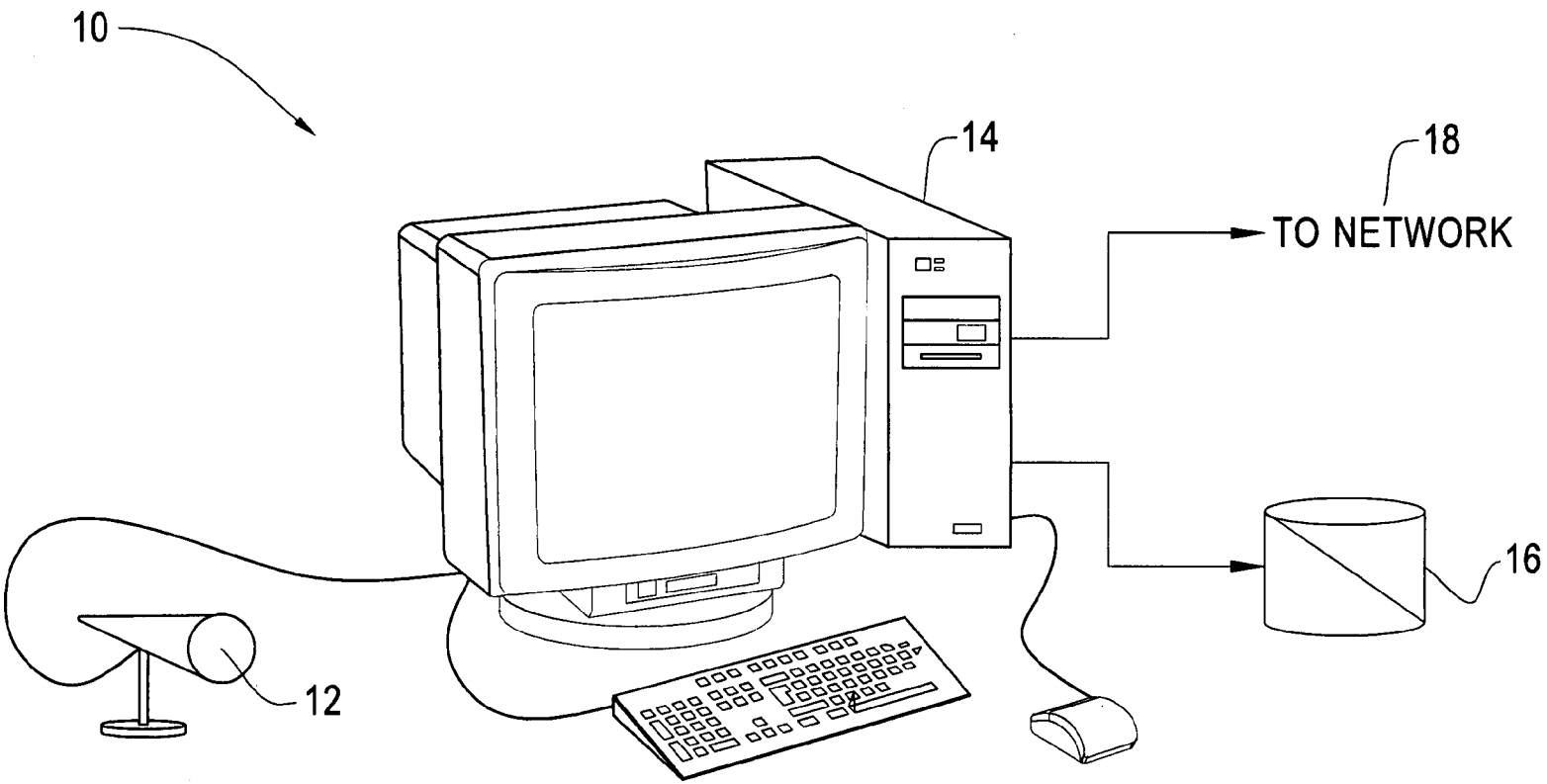
FIG. 1 is a block diagram showing a system employing a pitch Smoothing algorithm according to one embodiment of the invention.

Turning at first to FIG. 1, there is shown a generalized block diagram of a system that employs pitch tracking, in accordance with an embodiment of the invention. As shown, raw speech signal is received through input means, say microphone 12 and fed (after being converted into a digital signal) to a processor (in User PC 14 and associated storage 16) running appropriate known per se tool, say implemented in software, for Pitch detection (not shown explicitly in FIG. 1).

Apart from the pitch signal, the pitch detector may produce frame energy, which is some measure of the intensity of the signal in the frame in which the pitch was computed, and some measure of the quality of the pitch, which is the degree to which the signal can be described as a periodic signal with the detected pitch frequency. The so detected pitch signal, and possibly the energy and degree of fit, is (are) then fed to pitch tracking module (not shown explicitly in FIG. 1) for Smoothing the pitch signal, all as will be explained in greater detail below. In the case, of, say, speech compression, then the speech signal is subjected to known per se speech coding algorithm (e.g. spectral coding) and the coded signal is transmitted remotely, say through network 18.

The invention is, of course, not bound by the specific architecture and/or implementation and/or application (speech coding) of FIG. 1, and accordingly other variants are applicable, all as required and appropriate. By way of non-limiting example the implementation may be in distributed environment rather than in a stand alone PC environment.

Figure 2:
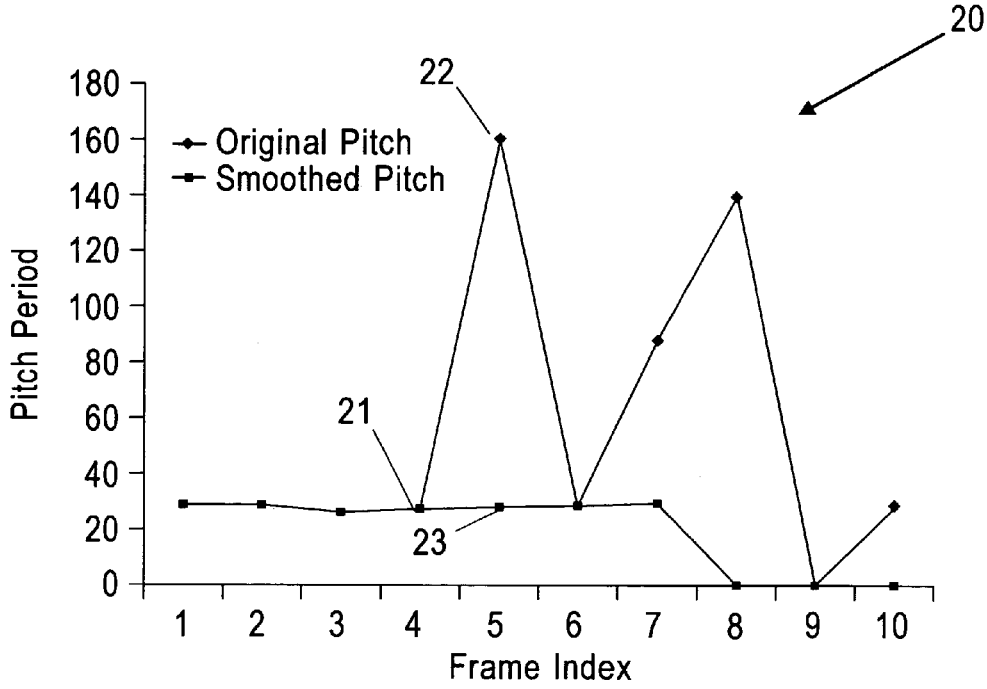
FIG. 2 illustrates a chart of sampled pitch values for a succession of frames.

There follows now a brief overview of the characteristics of the pitch signal which will assist in understanding the structure and operation of pitch tracking in accordance with the various embodiments of the invention. Thus, assuming that the vocal chords produce excitation whose frequency varies continuously with time, a sequence of successive correct (true) pitch values is always continuous, i.e. successive values are close in value to each other. Consider a detected pitch signal which normally contains correct and marred pitch values. Let p1 and p2 be two pitch values, (e.g. 21 and 22 in pitch signal 20 in FIG. 2). If p1 (e.g. 21) is a correct pitch value and p2 is a marred pitch value (e.g. 22) then the latter is a multiple m of the true pitch (i.e. the "Smoothed" pitch value, e.g. 23, that corresponds to the marred pitch value 22). The correct m can be found from the condition that the sequence {p1, p2/m} is smoothest. Smoothness is measured typically although not necessarily using the following distance measure between pitches:

$$D(p1,p2)=|(p1-p2)/(p1+p2)|$$

That means that p2/m (standing for the Smoothed pitch value, e.g. 23) is as close as possible to p1 where closeness is measured using the distance measure above. Similarly if p2 (i.e. the marred pitch value) is an integer (m) fraction of the true pitch (i.e. the corresponding Smoothed pitch value), then m can be found so that {p1,p2*m} is as smooth as possible in the sequence. The latter scenario where p2 (i.e. the marred pitch value) is an integer fraction of the true pitch, is not illustrated in FIG. 2.

The pitch tracking algorithm in accordance with the invention aims at deciding which values of the detected pitch signal are the true values and which are marred (i.e. they are integer multiple or fraction of a true [Smoothed] pitch value). The algorithm further smoothes the marred pitch value so as to obtain smooth pitch signal whenever this is possible.

In all embodiments, the algorithm operates on-the-fly and this is done, as a rule, with a given delay. For this reason the computation of the multiple (or fraction) for the value of the pitch at each instant must be based on the values of previous pitches and at most Tfuture future pitches, where Tfuture is the allowed delay. Thus, in accordance with one embodiment, the problem can be formulated as follows: Given Tpast past values of pitch and Tfuture future values find the integer which makes the current value most consistent with the past and future correct values of the pitch. Note that in all embodiments future and past values are taken into account (giving rise to a delay). The delay (Tfuture) may be set to be zero, which practically means that only past values are taken in consideration.

In order to decide which are the correct values (i.e. true pitch values) there is an underlying assumption that the pitch detector is more likely to find a correct value than a multiple or a fraction thereof. A sequence of pitch values is self-consistent if all the values are within some small factor of each other. Thus, two successive true pitch values p1,p2 in a consistent sequence are defined to have the property (hereinafter the factor property): factor>p1/p2>1/factor. The value of the factor should reflect the maximal allowed change between two true pitch values. By one embodiment it was chosen to be 1.28 for most tests. Note that normally its range is between 1.0 and 1.5.

In accordance with one embodiment, the sequence of original (i.e. detected) pitch values are partitioned according to some algorithm into subsequences of consistent pitch values in the sense defined above (i.e. complying with the factor property). Based on the assumption above that the pitch detector is more likely to find a true pitch then a multiple (or fraction) of the pitch, there will be more correct pitch values in the interval corresponding to each pitch point then incorrect ones (multiples or integer fractions). The interval contains the d future points and relevant past points. For this reason, the subsequences which have the true pitch values will normally have more significance (say more energy) then other sub-sequences.

Thus, in accordance with this embodiment a criterion for selecting the true pitch values is: using the true pitch values, deduced from the most significant subsequences, it is possible to find the multiples or fraction integers which make the current pitch values most consistent (closest) with the true pitch values of the sub-sequence. As will be explained in greater detail below by one embodiment an attempt is made to "fit" the current pitch value to be consistent with the most significant self consistent group of sub-sequences within allowed timed interval (normally extending over Tpast history pitch values and Tfuture future pitch values, where the latter are determined according to the allowed delay). To be self consistent, the end points of all the subsequences must be within Factor apart. The group of subsequences with the highest significance score (e.g. highest energy) is selected as the one for which the current pitch will fit. Note that the pitch values in a subsequence constitute a path (referred to, occasionally, also as trajectory). As is well known each pitch is associated with an energy and accordingly the energy of a path is computed, by one embodiment, by adding together the frame energies corresponding to each pitch value, and, the group of self consistent subsequences with the highest energy is selected. Note that the term energy will be used loosely here to represent any measure of the significance of that frame. Thus, frames with extremely low energy, probably contain a great deal of noise and therefore pitches computed on these frames are probably more likely to be erroneous. However, it may also be noted that this is true only for extremely low energies. For this reason, by one embodiment, some low power of the computed energy of the frame is a better measure of significance then the energy itself.

By this embodiment, having selected the subsequence (or subsequences) of largest energy, it (they) are used, based on past pitch values and on future pitch values, to smooth the current pitch value., i.e. to find the integer multiple or fraction of the current pitch whose value is closest to maintain consistent subsequence.

Figure 3:
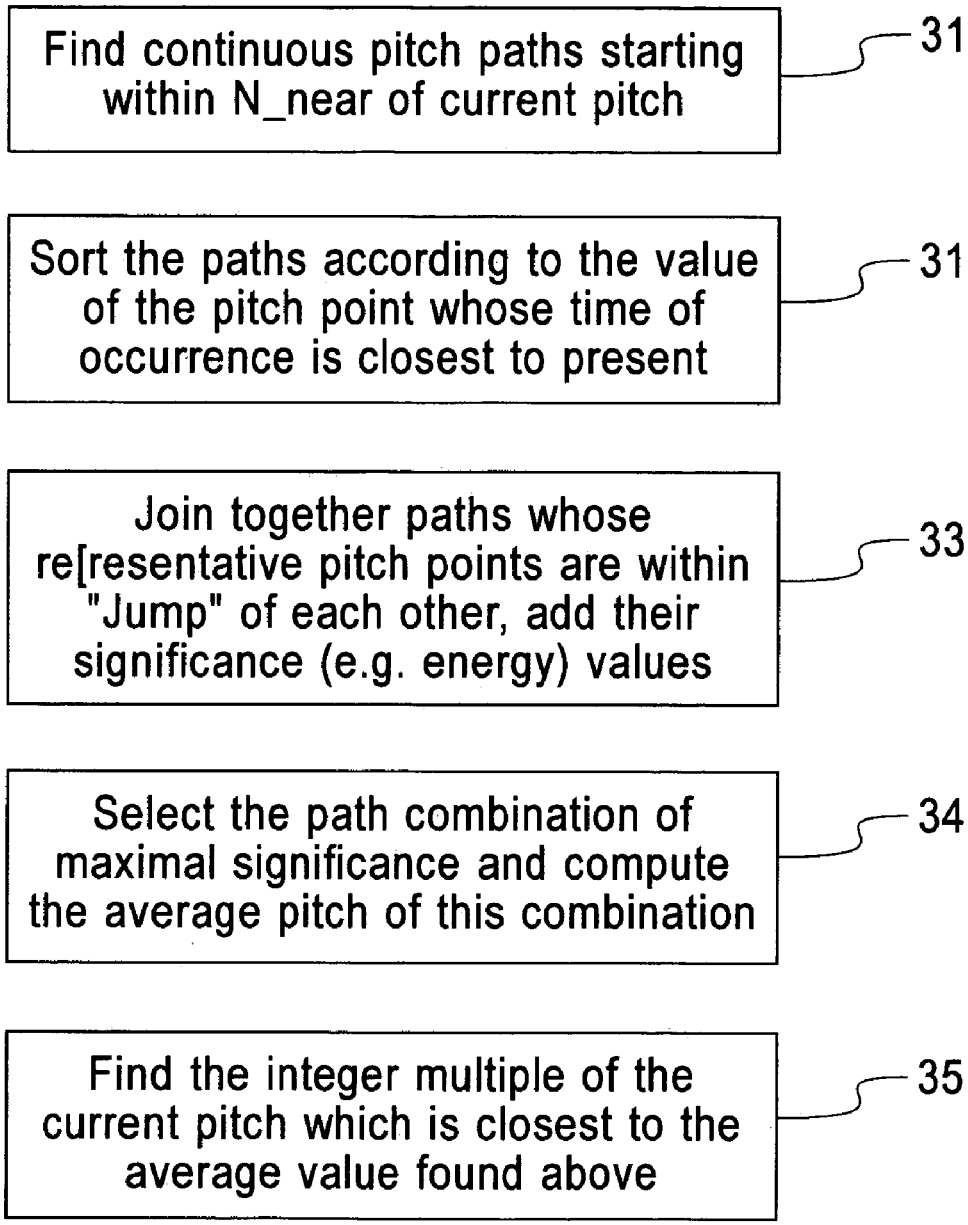
FIG. 3 illustrates a flow diagram of pitch tracking, in accordance with an embodiment of the invention.
Figure 4:
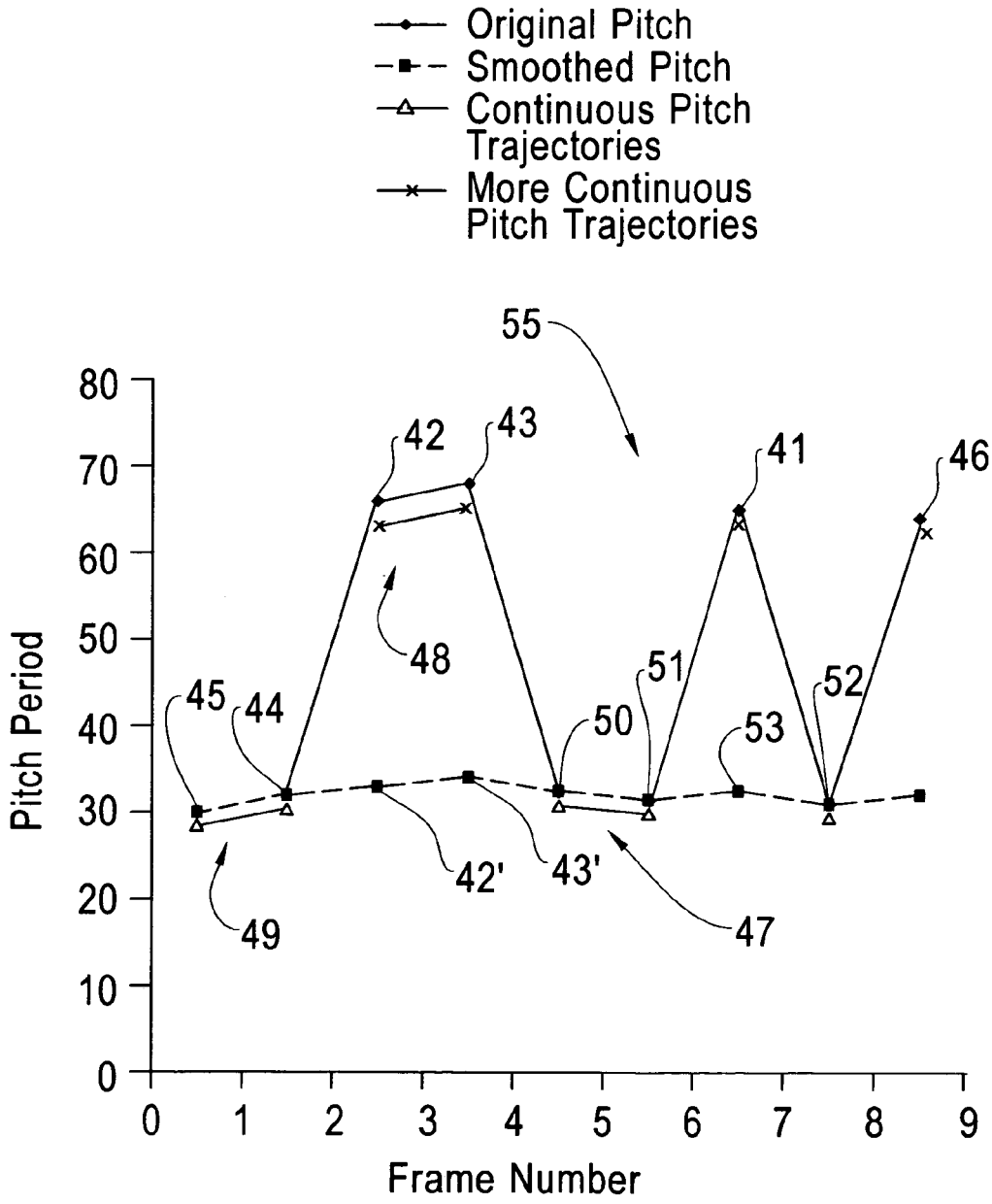
FIG. 4 illustrates a chart of pitch values for a succession of frames, identifying subsequences of pitches, in accordance with an embodiment of the invention.

Bearing this in mind, attention is drawn to FIG. 3 illustrating a flow diagram for determining pitch sequences, in accordance with an embodiment of the invention, and to FIG. 4 illustrating a chart of pitch values for a succession of frames, identifying subsequences of pitches, in accordance with an embodiment of the invention.

In the embodiment of FIG. 3, consistent pitch subsequences are calculated such that each includes succession of pitch values which are within factor of each other, i.e. factor>p1/p2>1/factor. For pitches p1 and p2 which are not successive but separated by a single time unit there exists some factor designated Lfactor which is larger then factor so that: Lfactor>p1/p2>sub-1/Lfactor. A sub-sequence where all pitch values are consistent with each other is a consistent sub-sequence. In accordance with another embodiment of the invention a consistent sub-sequence may include non consecutive pitches which comply with specified Lfactor characteristics. Each consistent sub-sequence of pitch values has one value (referred to as tail pitch value) corresponding to a time instant which is nearest in the sub-sequence to the current instant for which the true pitch is sought.

The procedure starts with original pitch values and its output is the set of smoothed pitch values. The smoothed pitch value for any time point Tcur, depends on Tpast pitch values preceding it and Tfuture pitch values which follow it. Thus, with reference to FIG. 4, assume that all pitch values in Frames 1 to 6 have already been processed in the manner that will be described in great detail below. As shown in FIG. 4, from among the so processed pitch values 1, 2, 5 and 6 were found by the pitch tracking algorithm to be true pitch values (i.e. the pitch detector detected the true values) and therefore there was no need to smooth them. In contrast, pitch values in Frame 3 and 4 (42 and 43 respectively) were classified by the pitch tracking as marred and were Smoothed by dividing them with a multiple integer to corresponding Smoothed values (42' and 43'). Note that, intuitively, the Smoothed pitch values (42') and (43') constitute together with their neighboring values a consistent sequence in the sense that each pitch value is "close" to its neighboring pitch value and no rapid change is encountered. (Such a rapid change can be noticed in the transition between true pitch (44) and marred pitch (42)).

Thus, after having processed the first 6 pitch values, the current Pitch value (Tcur) of Frame 7 (41) is processed in order to determine whether it is true or marred in the latter case to Smooth it. Assume that at most two future points, i.e. Tfuture=2 (dealy=2) and 6 past points i.e. Tpast=6 are allowed. This means that the subsequences are searched over the interval of Frame=1 (45) to Frame=9 (46). By this example, Tmax equals 5, signifying that the most remote tail pitch value of past subsequence should not precede Frame=2. Note that the Tpast, Tfutute and Tmax of this example were selected for illustrative purposes only and are by no means binding.

Thus, in step 31 (of FIG. 3) the algorithm searches for a collection of longest sub-sequences of adjacent pitch values p[j] so that: (A) j belongs to [Tcurrent−Tpast, Tcurrent+Tfuture] and (B) factor>p[j+1]/p[j]>1/factor for all pitch values for each sub-sequences.

Note that the search is performed in respect of the detected and not Smoothed values (i.e. pitch values 42 and 43 are taken in account and not 42' and 43'). As shown in FIG. 4, three consistent sub-sequences were revealed, i.e. sub-sequence (47) consisting of pitch values (50 and 51); sub-sequence (48) consisting of pitch values (42 and 43) and sub-sequence (49) consisting of pitch values (45 and 44). Note that for visibility, the subsequences (47) to (49) are slightly displaced downwardly.

Focusing on sub-sequence (47), it is shown that the pitch values of 50 and 51 are within factor value (assuming, for instance that factor=1.28), the pitch value of frame 4 (43) is not a member in the 47 sub-sequence since as readily noticed the pitch value of frame 4 (43) is considerably larger than the pitch value of frame 5 (50) and in any case the ratio P(Frame=4)/P(Frame=5) exceeds the permitted factor value. Sub-sequences 48 and 49 were determined in the same manner. Note that for all the sub-sequences the tail pitch value (i.e. 44 for subsequence 49; 43 for subsequence 48, and 51 for subsequence 47) whose time point is nearest to the current time point, is within Tmax (which as recalled is 5 by this example) of the current time point.

Note that no future subsequence(s) were revealed, since the pitch values of Frame 8 and 9 (46 and 52) do not comply with the factor criterion discussed above, and, therefore, they cannot reside in the same subsequence. In the case that a valid sub-sequence includes also one member, then additional two sub-sequences should be considered, a first consisting of the pitch value at frame 8 (52) and the second consisting of the pitch value at frame 9 (46).

Having determined the subsequences, the one with the highest significance is selected (step 34 in FIG. 3). Note, in passing, that a modified embodiment that utilizes steps (32 and 33) will be described below.

Reverting now to the example above, by one embodiment the significance of each sub-sequence is calculated by determining the cumulative energy value for each of the sub sequences, i.e. for each sub-sequence the energies of its constituent pitch values are summed giving rise to an energy score for each sub-sequence.

Assuming for example, In the example of FIG. 4, that sub-sequence 47 had the highest score, then the current pitch value is fitted thereto. To this end, (step 35) an integer value is calculated for the current pitch (of frame 7) so as to render it closest to the tail pitch value (51) of the selected sub-sequence (47). This results in Smoothed pitch value (53) which obviously complies with the factor constraint vis-a-vis its neighboring pitch values (52 and 51). Note that had the original pitch value of frame 7 been 53 (i.e. the pitch detector would detect true pitch value rather than marred one) an immediate test would have revealed that this pitch value complies with the factor characteristics, and therefore, the step of calculating multiple integer would have been obviated.

Having finalized the calculation for frame=7, the on the fly calculation continues now with respect to the next pitch value (52 or frame=8), and so forth.

Reverting now to steps 32 and 33 of FIG. 3, by a modified embodiment, in the case of "close" subsequences, they are gathered by groups and the current pitch value is fitted to a representative sub-sequence of the group. More specifically, the sub-sequences are sorted by tail pitch values and partitioned into groups of elements which are within factor apart from their neighbors (step (32). The energy of each group is obtained by summing the energies of the individual sub-sequences making up the group (step 33), giving rise to a representative sub-sequence. The group of tails with maximal total energy is selected. Now, a group representative tail pitch value is computed by, say the average tail pitch values of the distinct tail values of the sub-sequences in the group (step 34). Note that average is only an example and other variants such as picking the pitch value corresponding to the time period nearest to Tcur are also applicable. Finally, the current pitch value is multiplied or divided by an integer number so that it is nearest to that of computed average pitch value (step 35). For example, when reverting to FIG. 4, if the tail pitch values are sorted (step 32), it turns out that the tail pitch values 44 of sub-sequence 49, 51 of sub-sequence 47, and 52 (of future sub-sequence which consists solely of pitch 52), are all very close and are classified to the dame group. The other group consists of sub-sequence 48.

Note, incidentally, that for future sub-sequences the "tail" pitch is in fact the "head" one, i.e. the first value in the sub-sequence which is the nearest to the current pitch value. For convenience, the term "tail pitch value" signifies both the "tail" pitch value of past sub-sequences and "head" pitch value of future sub-sequences.

Reverting now to the example of FIG. 4, the representative sub-sequence for each group is computed by determining the significance, (being by this embodiment total energy) (step 33). Naturally, the group that consists of the three sub-sequences 47, 49 and 52 prevails (since the cumulative energy of the three sub-sequences is larger than that of sub-sequence (48) of the other group. Next, the representative tail pitch value is calculated, say, by averaging the distinct tail pitch values 44, 51 and 52, giving rise to average tail pitch value (step 34) and the Smoothing (if necessary) of the current pitch value is performed with respect to the representative pitch value in the manner specified above (step 35).

Accordingly, as has been explained above, there is provided a mechanism for generating sub sequences of the pitches which are consistent, and among them to choose the most significant. Significance may be measured for instance in terms of energy, and a measure of the quality of the pitch values which measures the degree to which the signal can be described as a periodic signal with the detected pitch frequency, or combination thereof. Other factors for significance may be used in addition or in lieu to the above, all as required and appropriate. By one embodiment, energy (either alone or combined with other parameters) is taken into account in the significance factor calculation if some pitch values are less likely to be correct than others. For example, frames which have a very low energy are likely to be less relevant then frames with a high energy. Similarly frames where the pitch detector found the pitch model to be a poor model for the spectrum of that frame should also be discounted. To this effect it is possible to use besides the energy, a measure of the degree to which the signal can be fitted with a periodic signal having the specified pitch. This usually yields one additional number per frame whose value is between zero and one and it could have a multiplicative effect on the energy.

Figure 5:
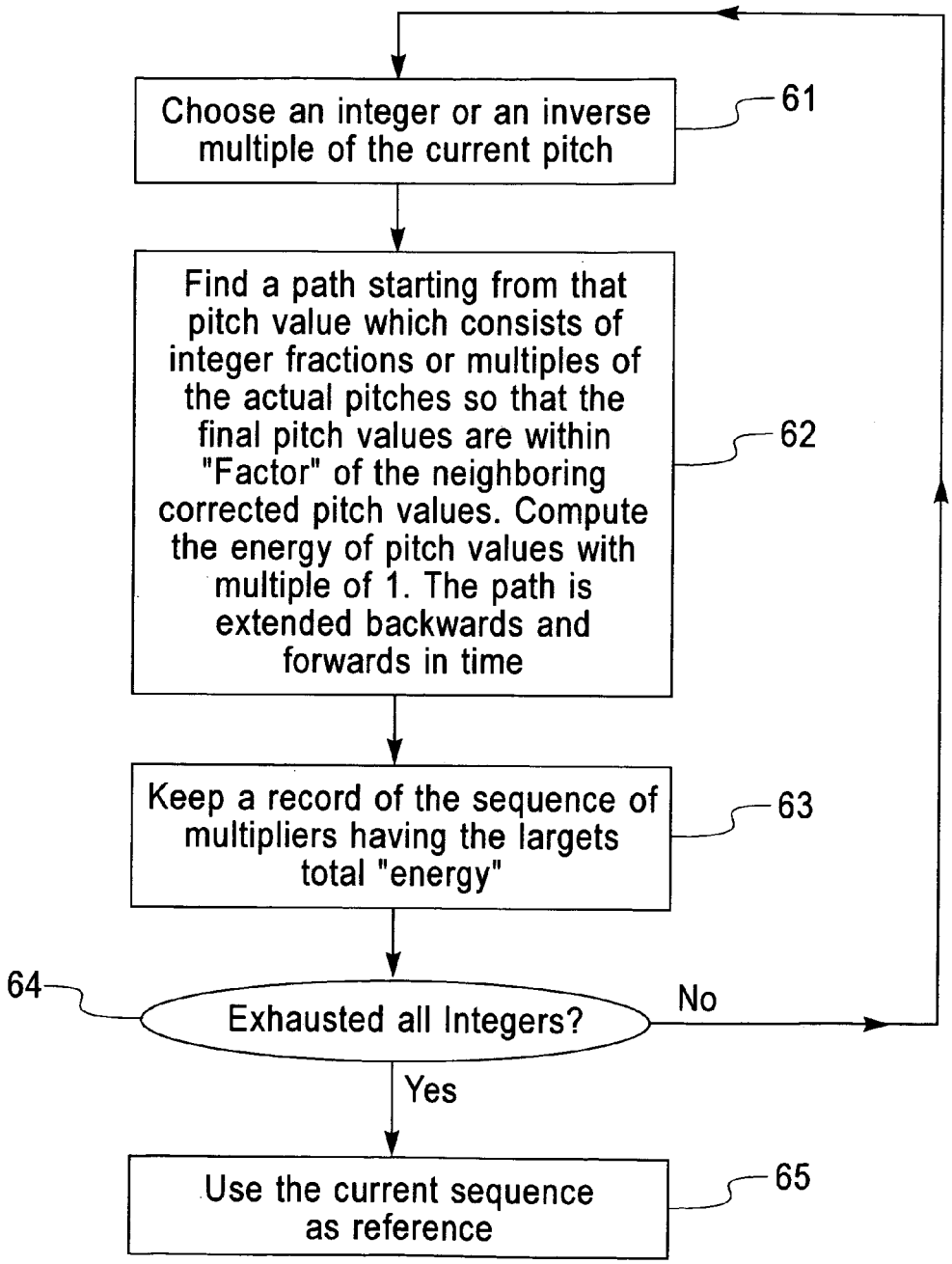
FIG. 5 illustrates a flow diagram of pitch tracking, in accordance with another embodiment of the invention.

By another embodiment, a consistent sequence will consist of all pitch values in the interval which are consistent with each other, where some pitch values are normalized by multiplication or division by some integer factor. This embodiment will be described with reference to FIG. 4 and also to FIG. 5.

Thus, in step (61) an integer or an inverse integer multiple of the current pitch is chosen. In the example of FIG. 4, and assuming again that the pitch value of Frame 7 is currently evaluated (after having processed pitch values 1 to 6), then, at first, the sampled value 41 is taken. (i.e. the integer value is 1).

Next, (step 62) a sub-sequence is found starting from the current pitch value (with integer multiples of 1) and a neighbor pitch value is normalized to the sub-sequence by applying integer fractions or multiples thereto so that the final pitch values are within "Factor" of the current pitch value. In the Example of FIG. 4, naturally, the neighboring pitch value 51 is not within factor (since it manifests a rapid change vis-a-vis 41) and, therefore, an integer multiple, say 2 is applied thereto giving rise to calculated pitch value 55 which is "within factor" with respect to the current pitch value 41. The multiple factor (by this example 2) is associated with the so calculated pitch value 55. In the same manner the sequence is extended backward and forward within the permitted. [Tcurrent−Tpast, Tcurrent+Tfuture] interval, such that each computed pitch value is within factor apart from its neighboring (calculated pitch value). After having completed the calculation of the subsequence, its significance is determined, e.g. as the number of pitch values having associated therewith a multiple factor of 1 (i.e. the number of pitch values in the subsequence which are retained intact and not subjected to normalization). In step 63 a comparison is made with the best significance obtained thus far and if a better significance results from the current frame it is replaced. In this way a record is kept of the best path thus far.

Now steps 61 to 63 are repeated for constructing another sub-sequence, again starting from the pitch value of Frame 7, this time however with an inverse integer 2. (As may be recalled in the first sub-sequence the pitch value of frame 7 had a multiple factor 1). Thus, when applying an inverse integer 2 (i.e. dividing by 2) the resulting calculated pitch value for frame 7 is 53 (in FIG. 4). Now, the neighboring pitch value (for frame 6) should fall in factor apart from that of frame 7 and as readily shown the pitch value for frame 6 (51) is within factor apart and accordingly its associated multiple factor is 1. The second sub-sequence is, likewise, extended backward and forward within the [Tcurrent−Tpast, Tcurrent+Tfuture] interval. The significance of the second sub-sequence is calculated in the same manner, i.e. as the number of pitch members whose associated multiplier factor is one.

Note that in departure from the previous embodiment where sub-sequences were non-overlapping (49, 48 and 47), in accordance with this embodiment the sub-sequences are overlapping in the sense that all sub-sequences extend over the range of Tpast to Tfuture.

In the same manner another sub-sequence is constructed for, say inverse multiple 3 (with respect of the pitch value of frame 7), and then another one for multiple 2 and another one for multiple 3 until all permitted integer multiples and inverse multiples are exhausted. ("YES" for step 64). Note that significance has been calculated for each sub-sequence and the current winner in terms of significance is kept at each step. What remains to be done is to identify the "winning" sub-sequence (step 65), i.e. the one having the highest significance score. The current pitch value (for frame=7) in the winning sub-sequence is already Smoothed in accordance with its associated multiple factor. Obviously, if the current pitch value for frame=7 in the winning sub-sequence is associated with multiple factor 1, it means that the pitch detector detected a true pitch value and not a marred one.

The procedure is now repeated in respect of the next pitch value (frame=8) and so forth. Also with respect to this embodiment various modifications may apply, e.g. the significance could be determined as a weighted values of energy significance factor and quality of pitch significance factor.

Note that by another embodiment the sub-sequence may also "skip over" a single zero pitch point and allow a larger factor in deciding on continuity. For example, the regular factor which was used was 1.28 and the larger factor, e.g. 1.4 is used. The latter is used because it represents more correctly the worst case jump for two steps. Two successive jumps of 1.28 are unlikely to belong to a proper pitch.

Note that various alterations and modifications may be carried out. For example, the first embodiment above, may be modified incorporate an extra step as follows:

In the case that the pitch trajectory does include jumps greater than factor, if the set of all pitch values which occur within the interval [Tcurrent−Tpast, Tcurrent+Tfuture] are sorted and partitioned into subsets so that within each subset the distance between successive points does not exceed factor, but the subsets are separated by a jump greater then factor, each of the pitch trajectories found above will have to lie within one of the subsets, and not in any other by definition. For this reason, it is possible to add an additional step in the algorithm above. It involves partitioning the sorted set of pitch values into subsets separated by jumps which are bigger then factor. The subset with the maximal energy is selected. The only trajectories considered in the algorithm described above will be those with values in the selected subset.

It will also be understood that the system according to the invention may be a suitably programmed computer. Likewise, the invention contemplates a computer program being readable by a computer for executing the method of the invention. The invention further contemplates a machine-readable memory tangibly embodying a program of instructions executable by the machine for executing the method of the invention.

The invention claimed is:

1. A method for tracking pitch signal, comprising:

(i) receiving a detected pitch signal that consists of succession of pitch values, and for each current pitch value in the detected signal perform at least the following (ii) to (iv):

(ii) constructing at least one sub-sequence of consistent pitch values from neighboring pitch values;

(iii) calculating significance of said at least one sub-sequences, and selecting a sub-sequence or a collection of consistent subsequences with highest significance;

(iv) if the current pitch value is not consistent with said sub-sequence with highest significance, smoothening the current pitch value by dividing it or multiplying it by an integer value>1, so as to render it consistent with said sub-sequence with highest significance.

2. The method according to claim 1, wherein said (ii) includes: at least one sub-sequence from said sub-sequences consists of pitch values that were calculated fall in the time range of [Tcurrent−Tpast,Tcurrent], where Tcurrent is the instant corresponding to the current pitch value and Tpast are H preceding pitch values; and wherein each two consecutive pitch values in the sub-sequence are factor apart, where 1.5>factor>1, and wherein every pitch value in the range [Tcurrent−Tpast, Tcurrent] belongs to a sub-sequence.

3. The method according to claim 2, wherein said (ii) includes: at least one sub-sequence from said sub-sequences consists of pitch values that fall in the range of [Tcurrent, Tfuture+Tcurrent], where Tcurrent is the current pitch value and Tfuture are D future pitch values; and wherein each two consecutive pitch values in the sub-sequence are factor apart, where 1.5>factor>1, and wherein every pitch value in the range [Tcurrent,Tfuture+Tcurrent] belongs to a sub-sequence.

4. The method according to claim 3, wherein said factor=1.28.

5. The method according to claim 2, wherein said factor=1.28.

6. The method according to claim 1, wherein said (ii) includes: at least one sub-sequence from said sub-sequences consists of pitch values that fall in the range of [Tcurrent, Tfuture+Tcurrent], where Tcurrent is the current pitch value and Tfuture are D future pitch values; and wherein each two consecutive pitch values in the sub-sequence are factor apart, where 1.5>factor>1, and wherein every pitch value in the ran ge [Tcurrent,Tfuture+Tcurrent] belongs to a sub-sequence.

7. The method according to claim 6, wherein said factor=1.28.

8. The method according to claim 1, wherein each pitch value in a sub-sequence is associated with an energy value and wherein said significance, stipulated in (iii), depends on an energy of the sub-sequence, the latter being a function of the energy values of the pitch values of the sub-sequence.

9. The method according to claim 8, wherein said energy of the sub-sequence being the sum of the energy values of the pitch values of the sub-sequence.

10. The method according to claim 1, wherein each sub-sequence has a tail pitch value, and wherein said (iv) includes: smoothening the current pitch value by dividing it or multiplying it by an integer value>1, so as to render it consistent with the tail pitch value of said sub-sequence with highest significance.

11. The method of claim 1, wherein said (iii) includes: sorting tail pitch values of said sub-sequences and grouping said sub-sequences according to said sorted tail pitch values such that sub-sequences with close tail pitch values reside in the same group, and wherein said calculating of significance includes: calculating significance of all sub-sequences in each group, and selecting a group with highest significance; and wherein said (iv) includes if the current pitch value is not consistent with said sub-sequences in the group with highest significance, smoothening the current pitch value by dividing it or multiplying it by an integer value>1, so as to render it consistent with said group with highest significance.

12. The method according to claim 11, wherein the tail pitch values of the sub-sequences in the group with highest significance are averaged, giving rise to an average tail pitch value, and wherein said (iv) includes: if the current pitch value is not consistent with said average tail pitch value, smoothening the current pitch value by dividing it or multiplying it by an integer value>1, so as to render it consistent with said average tail pitch value.

13. The method according to claim 11, wherein each pitch value in a sub-sequence is associated with an energy value and wherein said significance, stipulated in (iii), depends on the energy of the sub-sequence, the latter being a function of the energy values of the pitch values of the sub-sequence.

14. The method according to claim 13, wherein the energy of the sub-sequence being the sum of the energy values of the pitch values of said sub-sequence.

15. A method for tracking pitch signal, comprising:

(i) receiving a detected pitch signal that consists of succession of pitch values, and for each current pitch value in the detected signal as well as any integer multiple and inverse integer multiple thereof, where said integer<predetermined value, perform at least the following (ii) to (iii):

(ii) constructing at least one sub-sequence of consistent pitch values from neighboring pitch values; if a detected pitch value is not consistent with said sub-sequence dividing it or multiplying it by an integer value>1, so as to render it consistent with said sub-sequence;

(iii) calculating significance of said at least one sub-sequences, and selecting a sub-sequence with highest significance, thereby rendering the current pitch value smoothened.

16. The method according to claim 15, wherein said (ii) includes: at least one sub-sequence from said sub-sequences consists of pitch values that were calculated fall in the time range of [Tcurrent−Tpast,Tcurrent], where Tcurrent is the instant corresponding to the current pitch value and Tpast are H preceding pitch values; and wherein each two consecutive pitch values in the sub-sequence are factor apart, where 1.5>factor>1, and wherein every pitch value in the range [Tcurrent−Tpast, Tcurrent] belongs to a sub-sequence.

17. The method according to claim 16, wherein said (ii) includes: at least one sub-sequence from said sub-sequences consists of pitch values that fall in the range of [Tcurrent, Tfuture+Tcurrent], where Tcurrent is the current pitch value and Tfuture are D future pitch values; and wherein each two consecutive pitch values in the sub-sequence are factor apart, where 1.5>factor>1, and wherein every pitch value in the range Tfuture- Tcurrent belongs to a sub-sequence.

18. The method according to claim 16, wherein said factor=1.28.

19. The method according to claim 15, wherein said (ii) includes: at least one sub-sequence from said sub-sequences consists of pitch values that fall in the range of [Tcurrent, Tfuture+Tcurrent], where Tcurrent is the current pitch value and Tfuture are D future pitch values; and wherein each two consecutive pitch values in the sub-sequence are factor apart, where 1.5>factor>1, and wherein every pitch value in the range [Tcurrent,Tfuture+Tcurrent] belongs to a sub-sequence.

20. The method according to claim 19, wherein said factor=1.28.

21. The method according to claim 19, wherein said factor=1.28.

22. The method according to claim 15, wherein said significance depends on the number of pitch values in the subsequence which were not subjected to said dividing or multiplication.

23. A system for tracking pitch signal, comprising: receiver for receiving a detected pitch signal that consists of succession of pitch values, and for each current pitch value in the detected signal perform at least the following (ii) to (iv), by a processor:

(ii) constructing at least one sub-sequence of consistent pitch values from neighboring pitch values;

(iii) calculating significance of said at least one sub-sequences, and selecting a sub-sequence or a collection of consistent subsequences with highest significance;

(iv) if the current pitch value is not consistent with said sub-sequence with highest significance, smoothening the current pitch value by dividing it or multiplying it by an integer value>1, so as to render it consistent with said sub-sequence with highest significance.

24. A system for tracking pitch signal, comprising:

receiver for receiving a detected pitch signal that consists of succession of pitch values, and for each current pitch value in the detected signal as well as any integer multiple and inverse integer multiple thereof, where said integer<predetermined value, perform at least the following (ii) to (iii) by a processor:

(ii) constructing at least one sub-sequence of consistent pitch values from neighboring pitch values; if a detected pitch value is not consistent with said sub-sequence dividing it or multiplying it by an integer value>1, so as to render it consistent with said sub-sequence;

(iii) calculating significance of said at least one sub-sequences, and selecting a sub-sequence with highest significance, thereby rendering the current pitch value smoothened.

25. A computer product containing a computer code for performing tracking pitch signal, including:

receiver for receiving a detected pitch signal that consists of succession of pitch values, and for each current pitch value in the detected signal perform at least the following (i) to (iii):

(i) constructing at least one sub-sequence of consistent pitch values from neighboring pitch values;

(ii) calculating significance of said at least one sub-sequences, and selecting a sub-sequence or a collection of consistent subsequences with highest significance;

(iii) if the current pitch value is not consistent with said sub-sequence with highest significance, smoothening the current pitch value by dividing it or multiplying it by an integer value>1, so as to render it consistent with said sub-sequence with highest significance.

26. A computer product containing a computer code for performing tracking pitch signal, including:

(i) receiving a detected pitch signal that consists of succession of pitch values, and for each current pitch value in the detected signal as well as any integer multiple and inverse integer multiple thereof, where said integer<predetermined value, perform at least the following (ii) to (iii):

(ii) constructing at least one sub-sequence of consistent pitch values from neighboring pitch values; if a detected pitch value is not consistent with said sub-sequence dividing it or multiplying it by an integer value>1, so as to render it consistent with said sub-sequence;

(iii) calculating significance of said at least one sub-sequences, and selecting a sub-sequence with highest significance, thereby rendering the current pitch value smoothed.

* * * * *